United States Patent [19]

Leever

[11] Patent Number: 4,773,108

[45] Date of Patent: Sep. 27, 1988

[54] MEANS FOR SECURING AND MAINTAINING BED COVERS

[75] Inventor: Thomas P. Leever, Houston, Tex.

[73] Assignee: Waterbed Corners, Inc., Houston, Tex.

[21] Appl. No.: 60,255

[22] Filed: Jun. 9, 1987

[51] Int. Cl.[4] ..... A47C 21/02

[52] U.S. Cl. ..... 5/504; 5/508; 24/72.5

[58] Field of Search ..... 5/508, 451, 504, 503, 5/411, 496, 498; 24/72.5

[56] References Cited

U.S. PATENT DOCUMENTS

| | | | |
|---|---|---|---|
| 2,154,557 | 4/1939 | Bechik | 5/411 |
| 2,653,363 | 9/1953 | Lievsay, Jr. | 24/72.5 |
| 4,539,723 | 9/1985 | Hillsberry | 5/508 |

*Primary Examiner*—Alexander Grosz

*Attorney, Agent, or Firm*—Bill B. Berryhill

[57] ABSTRACT

A corner retainer for securing and maintaining bed covers on the mattress of a bed formed by first, second and third planar portions which intersect each other at substantially right angles and which meet at a point to form a trihedral corner. The corner retainer is positionable at the corner of the mattress and when bed covers are placed thereover wedge the bed covers between the retainer and a surrounding portion of the bed.

6 Claims, 1 Drawing Sheet

MEANS FOR SECURING AND MAINTAINING BED COVERS

BACKGROUND OF THE INVENTION

1. Field of the Invention

The present invention pertains to means for securing and maintaining bed covers on the mattress of a bed. More specifically, the present invention pertains to means for securing and maintaining bed covers on water bed mattresses.

2. Brief Description of the Prior Art

Most beds are usually made up with at least two sheets, a bottom sheet and a top sheet. The sheets are customarily tucked under the ends and sides of the mattress, so that the edges of the sheet are sandwiched between the mattress and the box springs or other mattress support. In some cases, the bottom sheet may be fitted so that when placed on the mattress it is held in place primarily by the fitting and elasticity of special corners created therefor.

One of the problems with bed covers is the fact that they frequently work out from between the mattress and the box springs so that the bedding is no longer completely tucked in or secured. This occurs, among other reasons, due to a person repeatedly changing positions during sleeping by shifting and turning from side to side. Such movement, causes the bed covers to be worked loose. Working loose of the bed covers results in uncovering the sleeper and causes him/her to be uncomfortable. It also requires extra work in remaking the bed.

A number of devices have been invented to help secure bed coverings on mattresses. Most of these devices are in the form of some type of clip mechanism in which the bed covers are held in place by friction engaging clip components. Examples of such may be seen in U.S. Pat. Nos. 4,089,075; 4,276,667; 4,520,518 and 4,541,137. Another solution is shown in U.S. Pat. No. 4,336,635. While all of these devices result in improved holding and securing of bed covers, they are primarily for use with conventional mattress bedding and would not be suitable for water beds which have become so popular today.

SUMMARY OF THE PRESENT INVENTION

The present invention provides means for securing and maintaining bed covers of the mattress of a bed which is especially adapted and suitable for use with water beds. Such means includes at least one corner retainer for placement at the corners of a mattress. The retainer is formed by first, second and third planar portions which intersect each other at substantially right angles and which meet at a point forming a trihedral corner. The corner retainer is positionable at the corner of the mattress with the first planar portion being under the mattress, the second and third planar portions extending at right angles of each other, one along a longitudinal edge of the mattress and another along a transverse edge of the mattress, to secure and maintain bed covers placed on the mattress. In a preferred embodiment, the corner retainer includes a forth planar portion spaced above and paralled to the first planar portion which intersects the second and third planar portions at substantially right angles meeting at a point to form a second trihedral corner. The corner retainer is thus a triangular envelope which may be placed on the corner of the mattress, and when the bed covers are placed thereon, wedge the bed covers between the retainer and the bed frame to secure and maintain the bed covers on the mattress.

While the corner retainers of the present invention are useful in maintaining the bed covers on any mattress, they are especially effective on a water mattress in that they are not easily displaced from the corner of the mattress even with the movement of water therein. Most of the prior art devices would not function as effectively on a water mattress. The securing and maintaining devices of the present invention are relatively simple to manufacture, relatively inexpensive and easy to use. Many other objects and advantages of the invention will be apparent from reading the description which follows in conjunction with the accompanying drawings.

DESCRIPTION OF A PREFERRED EMBODIMENT

Figure 1:
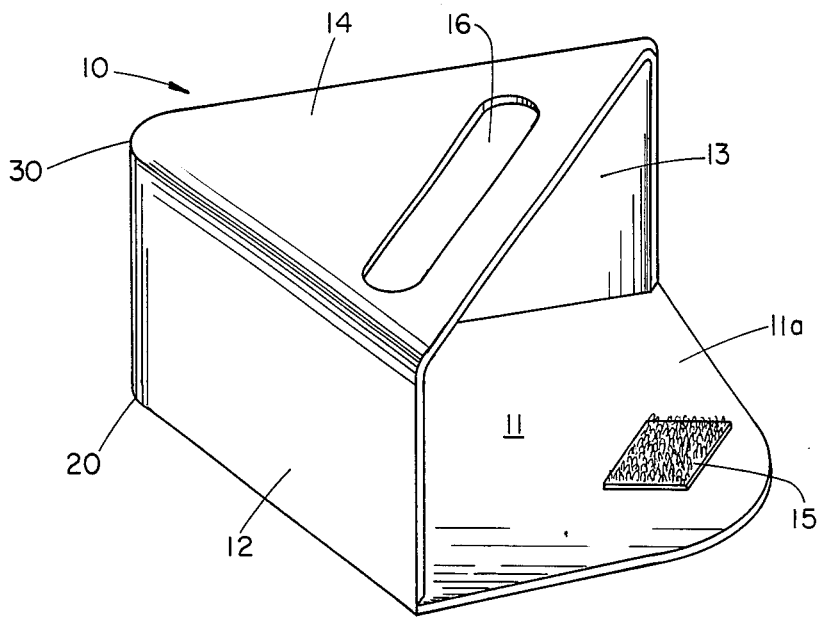
FIG. 1 is a perspective view of a corner retainer forming a portion of means for securing and maintaining bed covers on the mattress of a bed, according to a preferred embodiment of the invention.

The present invention provides means for securing and maintaining bed covers on the mattress of a bed and comprises, as shown in FIG. 1, at least one corner retainer 10. The corner retainer 10 is formed by a first planar portion 11, a second planar portion 12 and a third planar portion 13 which intersect each other at substantially right angles and which meet at a point forming a first trihedral corner 20. A forth planar portion 14 may also be provided which is parallel to first planar portion 11 and which intersects the second and third planar portions 12 and 13 at substantially right angles thereto, meeting at a point to form a second trihedral corner 30 directly above the first trihedral corner 20. Although the corners 20 and 30 may be pointed, they are preferrably rounded as shown in FIG. 1.

The first planar portion 11 may extend or project further from the first trihedral corner 20 than the upper planar portion 14 projects from the second trihedral corner 30 to form an extension or tongue ll*a*. If desired, a piece of interengaging fabric 15 such as the type sold under the trade name "Velcro" may be fixed to the tongue ll*a*. A corresponding portion (not shown) may be affixed to a mattress pad (not shown) to prevent slippage of the pad relative to the mattress and retainer. It will also be noted that an aperture 16 may be provided in the forth planar portion 14 near the edge thereof to provide a means of grasping the retainer 10 with the hand.

Figure 2:
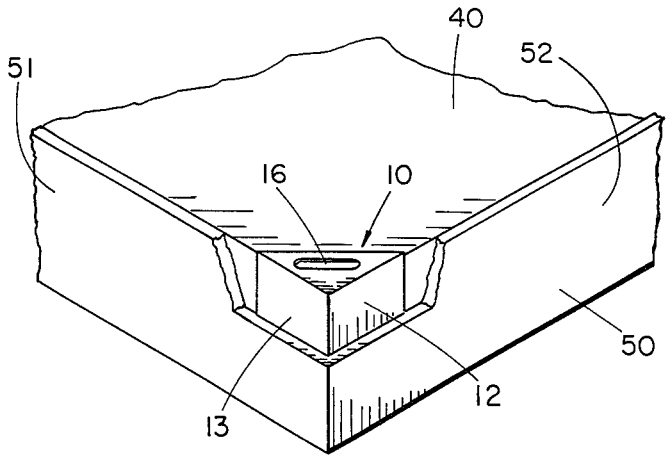
FIG. 2 is a perspective view of the corner retainer of FIG. 1 placed on the corner of a mattress and over which bed covers are placed for wedging between the retainer and frame.

Referring also now to FIG. 2, there is shown a water mattress 40 supported on a support or frame 50. The frame has side portions 51 and 52 portions of which are cut away at the corner for a better understanding of the invention. As shown, a corner retainer 10 has been positioned at one corner of the mattress 40. It is, of course, understood that one of the corner retainers 10 may be placed at all four corners of the mattress if desired. The corner retainer 10 is positioned so that the first planar portion 11 and the tongue extention 11*a* thereof (see FIG. 1) is sandwiched between the mattress 40 and the mattress support or frame 50. In this position, the second and third planar portions 12 and 13 extend at right angles from each other, one along a longitudinal edge of the mattress and the other along a transverse edge of the mattress. The bed covers (not shown) are then placed over the mattress 40 and the corner retainer 10. The force of the water in the mattress 40 pushes against the retainer wedging the bed covers (not shown) between the retainer 10 and the sides 51, 52 of the frame 50. The corner retainer 10 thus secures and maintains bed covers which are placed on the mattress 40 and over the retainer 10.

As described, the present invention provides means for securing and maintaining bed covers on the mattress of the bed. The unique corner retainer 10 thereof, is especially useful for securing bed covers to a water mattress in which there is great movement due to the water therein. The corner retainer 10 will stay in place and maintain the covers much more efficiently than the devices of the prior art, particularly when used on a water mattress.

A single embodiment of the invention has been described herein. However, many variations thereof can be made without departing from the spirit of the invention. Accordingly, it is intended that the scope of the invention be linited only by the claims which follow.

I claim:

1. Means for securing and maintaining bed covers on the mattress of a bed, said means comprising at least one corner retainer formed by first, second and third planar portions which intersect each other at substantially right angles and which meet at a point forming a first trihedral corner and a fourth planar portion spaced above and parallel to said first planar portion also intersecting said second and third planar portion at substantially right angles thereto and meeting at a point to form a second trihedral corner above said first trihedral corner, said corner retainer being positionable at the corner of said mattress, said first planar portion being insertable under said mattress, said fourth planar portion being positionable on top of said mattress and said second and third planar portions extending at right angles from each other, one along a longitudinal edge of said mattress and the other along a transverse edge of said mattress, to secure and maintain bed covers placed on said mattress.

2. The bed covers securing and maintaining means of claim 1 in which said fourth planar portion is spaced above said first planar portion by a distance approximately equal to the thickness of said mattress.

3. The bed covers securing and maintaining means of claim 2 in which said first planar portion extends away from said first trihedral corner for a greater distance than said fourth planar portion extends away from said second trihedral corner.

4. The bed covers securing and maintaining means of claim 2 in which said fourth planar portion is substantially triangular in shape and in which an aperture is provided near the edge thereof fartherest from said second trihedral corner providing means by which said corner retainer may be positioned at the corner of said mattress by hand.

5. The bed covers securing and maintaining means of claim 1 in which a piece of interengaging fabric is attached to a surface of said first planar portion for engagement with corresponding interengaging fabric of a mattress of the like.

6. The bed covers securing and maintaining means of claim 1 in which said first and second trihedral corners are slightly rounded.

* * * * *